US005623753A

United States Patent [19]

Tamura

[11] Patent Number: 5,623,753

[45] Date of Patent: Apr. 29, 1997

[54] APPARATUS FOR PRODUCING ELECTRIC WIRES WITH TERMINALS

[75] Inventor: Yoshikazu Tamura, Kanazawa, Japan

[73] Assignee: Sumitomo Wiring Systems, Ltd., Mie, Japan

[21] Appl. No.: 518,401

[22] Filed: Aug. 15, 1995

[30] Foreign Application Priority Data

Aug. 30, 1994 [JP] Japan ..... 6-205705

[51] Int. Cl.[6] ..... H01R 43/00

[52] U.S. Cl. ..... 29/33 M; 29/748; 29/755; 364/474.22

[58] Field of Search ..... 29/33 M, 33 F, 29/755, 564.4, 564.6, 748; 364/474.37, 562, 474.01, 474.22; 140/105

[56] References Cited

U.S. PATENT DOCUMENTS

| | | | |
|---|---|---|---|
| 5,033,188 | 7/1991 | Polliard | 29/861 |
| 5,050,093 | 9/1991 | Reddy et al. | 364/562 X |
| 5,067,379 | 11/1991 | Butler et al. | 364/474.37 |
| 5,282,311 | 2/1994 | Tamura | 29/825 |
| 5,483,459 | 1/1996 | Tamura | 29/755 |
| 5,514,966 | 5/1996 | Kawamura et al. | 324/539 |
| 5,522,130 | 6/1996 | Wollermann | 29/33 F X |

FOREIGN PATENT DOCUMENTS

| | | |
|---|---|---|
| 4-270020 | 9/1992 | Japan . |
| 5-250935 | 9/1993 | Japan . |

*Primary Examiner*—William R. Briggs
*Attorney, Agent, or Firm*—Beveridge, DeGrandi, Weilacher & Young, LLP

[57] ABSTRACT

An apparatus for producing a plurality of types of electric wires with a terminal or terminals. Production condition data required to produce a plurality of types of electric wires with a terminal or terminals are previously stored in a memory. Responsive to that a certain type of electric wire with a terminal or terminals has been produced on the basis of one piece of production condition data, production condition data corresponding to an electric wire with a terminal or terminals to be subsequently produced are read out. The data read out and production condition data corresponding to the electric wire with a terminal or terminals which has been produced are compared with each other, to extract the portions of data which differ in contents. The extracted portions of data are displayed on a display. A worker can grasp the contents required for rearrangement such as changes in setting conditions and components to be replaced by watching the contents of display on the display.

19 Claims, 12 Drawing Sheets

FIG. 8

521

FIFO TABLE

| AREA | CONTENT |
|---|---|
| 1 | PRODUCTION CONDITION DATA A (LENGTH OF CUTTING, NUNBER OF WIRES ···) |
| 2 | PRODUCTION CONDITION DATA B ····· |
| 3 | PRODUCTION CONDITION DATA C ····· |
| 4 | PRODUCTION CONDITION DATA D ····· |
| ⋮ | |

F I G. 10

42

| | NAME OF TERMINALS TO BE REPLACED | APPLICATOR | STRIPPING LENGTH |
|---|---|---|---|
| No. 1 | MTO90FL | 45 | 5. 6 mm |
| No. 2 | HSG25OF | 32 | 4. 3 mm |

TYPE AND SIZE USED : ○○××○○

| | |
|---|---|
| CONFIRMATION | STRIPPING LENGTHS FOR No. 1 AND No. 2 ARE TO CHANGE. |
| CONFIRMATION | TYPE AND SIZE ARE TO CHANGE. |
| CONFIRMATION | V/H FOR No. 1, AND C/H AND V/H FOR No. 2 ARE TO CHANGE. |

46

FIG. 12

REPLACE WIRES WHEN 11 MORE MEASURED AND PROCESSED WIRES ARE PRODUCED.

LENGTH OF WIRE TO BE ADDED IS 429mm.

SUBSEQUENT WIRE

| TYPE | SIZE | COLOR |
|---|---|---|
| AVSS | 0.5 | B |

JOINT AFTER CONFIRMATION.

APPARATUS FOR PRODUCING ELECTRIC WIRES WITH TERMINALS

BACKGROUND OF THE INVENTION

1. Field of the Invention

The present invention relates to an apparatus for producing electric wires with terminals by performing the steps of: measuring the length of an electric wire, cutting the electric wire to predetermined lengths, stripping insulative sheaths at both ends of the cut electric wire, and crimping terminals against both ends of the electric wire to produce a measured and processed electric wire. Numbers of measured and processed electric wires are bundled, for example, to manufacture a wiring harness.

2. Description of the Related Art

A wiring harness incorporated in an automobile, a copying machine or the like is constructed by bundling numbers of measured and processed electric wires. A measured and processed electric wire is an electric wire having a predetermined length obtained by cutting and having terminals crimped against both its ends. As an apparatus for producing measured and processed electric wires with terminals, an apparatus for cutting an electric wire to predetermined lengths, stripping insulative sheaths at both ends of the cut electric wire, and crimping terminals against both the ends of the electric wire has been known (see, Japanese Patent Laid-Open Gazette No. 270020/1992, for example).

Furthermore, an apparatus having a so-called intermediate portion stripping mechanism further added to the above described apparatus has been filed as a prior application by the applicant of the present invention (see Japanese Patent Laid-Open Gazette No. 250935/1993).

Where measured and processed electric wires are produced by the above described apparatus according to the prior art, the contents of control of the apparatus must be changed if the conditions of production such as the length of an electric wire are changed. In some cases, electric wires must be replaced, or terminals and applicators for terminal crimping must be replaced. That is, if the conditions of production are changed, rearrangement work must be performed.

For example, consider a case where $Q_1$ measured and processed electric wires each having a length $L_1$ are produced from an electric wire of the type A and then, $Q_2$ measured and processed electric wires each having a length $L_2$ are produced from an electric wire of the same type A. In this case, control of the timing of cutting by the apparatus, for example, must be changed depending on a case where the former measured and processed electric wires each having a length $L_1$ are produced and a case where the latter measured and processed electric wires each having a length $L_2$ are produced.

Furthermore, consider a case where $Q_2$ measured and processed electric wires each having a length $L_2$ are produced from an electric wire of the type A and then, $Q_3$ measured and processed electric wires each having a length $L_3$ are produced from an electric wire of the type B and subsequently, $Q_4$ measured and processed electric wires each having a length $L_4$ are produced from an electric wire of the type C. In this case, the contents of control of the apparatus must be changed for each type of measured and processed electric wire to be produced. Moreover, electric wires must be replaced. Further, terminals or applicators for terminal crimping must be replaced and adjusted (a crimp height and a vinyl height must be adjusted) as the electric wires are replaced.

Processing for changing the contents of control and the contents of setting with the change in the conditions of production, that is, rearrangement is required several tens of times a day, for example, in one apparatus for producing electric wires with terminals. The reason for this is that one apparatus for producing electric wires with terminals generally produces several tens of types of measured and processed electric wires a day.

In the apparatus for producing electric wires with terminals, rearrangement work is thus frequently performed. Therefore, it is required that this rearrangement work can be simply and correctly performed in a short time and irrespective of the degree of skill of a worker, for example.

As the rearrangement on the apparatus for producing electric wires with terminals, the contents of control and components such as applicators have been conventionally changed after a worker judges the contents of the rearrangement. Therefore, time required for the rearrangement is liable to be long. In addition, time required for the rearrangement varies depending on the degree of skill, the degree of fatigue and the like of the worker.

Furthermore, the rearrangement work is performed several tens of times a day as described above. Therefore, the worker may, in some cases, erroneously read an information sheet on which the conditions of production are described or erroneously switches terminals, electric wires and the like.

SUMMARY OF THE INVENTION

Therefore, an object of the present invention is to reduce the time required for rearrangement on an apparatus for producing electric wires with a terminal or terminals.

Another object of the present invention is to provide an apparatus for producing electric wires with a terminal or terminals capable of being smoothly performed during rearrangement work thereon without being affected by the degree of skill, the degree of fatigue and the like of a worker.

Still another object of the present invention is to provide an apparatus capable of displaying the contents of the setting of a measured and processed electric wire which is currently being produced and informing a worker which content of setting must be changed in the rearrangement.

In the present invention, electric wires with a terminal or terminals are successively produced on the basis of a plurality of pieces of data previously stored. Where a certain electric wire with a terminal or terminals is produced on the basis of one piece of data stored, when the production process based on the data is completed, data for an electric wire with a terminal to be subsequently produced are read out. The data read out are compared with the data for the preceding production process, and only different portions of the data are extracted. The different portions of the data are displayed by displaying means.

When a production process of a certain electric wire with a terminal or terminals is completed, the worker must perform rearrangement work on the apparatus so as to produce the subsequent electric wire with a terminal or terminals. The worker can grasp the setting conditions, components to be replaced, and the like without errors by watching the different portions of the data displayed on the displaying means. Accordingly, the rearrangement work can be performed quickly and correctly.

With an apparatus for producing electric wires with a terminal or terminals according to the present invention, rearrangement work can be performed simply and correctly irrespective of the degree of skill and the like of a worker. In addition, only the information required for the rearrangement is displayed. Therefore, the worker may only perform the rearrangement work on the basis of the contents of the display. Consequently, it is possible to prevent errors in the rearrangement, for example.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 8 is an illustration of an FIFO table;

FIG. 10 is a diagram showing an example of display on a display 42 at the time of rearrangement;

FIG. 12 is a diagram showing still another example of display on the display 42 at the time of rearrangement.

DESCRIPTION OF THE PREFERRED EMBODIMENTS

Figure 1:
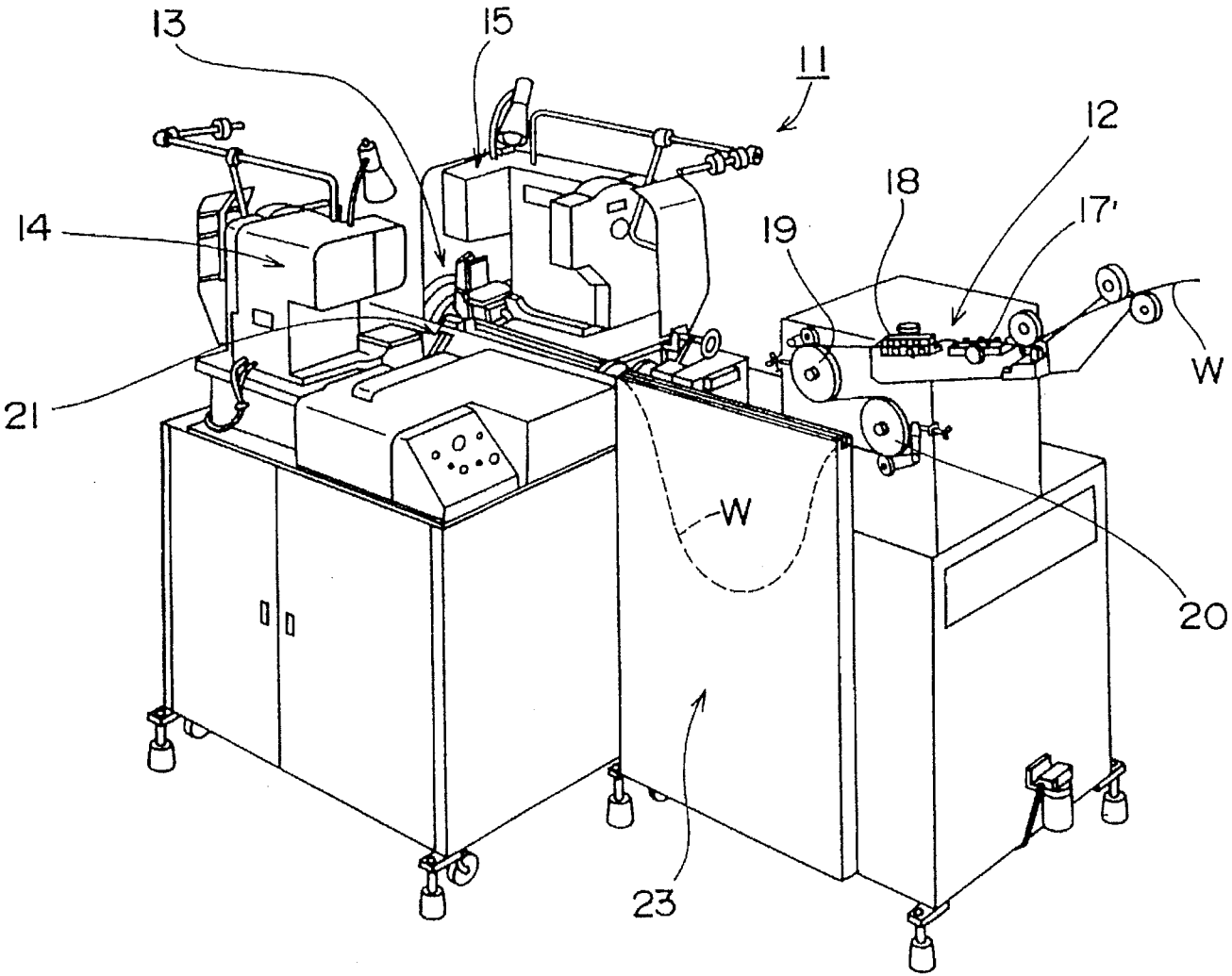
FIG. 1 is a perspective view showing a processor 11 which is one of components of an apparatus for producing electric wires with a terminal or terminals according to one embodiment of the present invention.

FIG. 1 is a perspective view showing a processor 11 which is one of components of an apparatus for producing electric wires with a terminal or terminals according to one embodiment of the present invention. The apparatus for producing electric wires with a terminal or terminals according to the present embodiment includes the processor 11 shown in FIG. 1 and a control device 40 as described later. The processor 11 operates on the basis of a control signal from the control device 40.

Referring to FIG. 1, the processor 11 includes a measured length feeding section 12, a cutting and stripping section 13, a first terminal crimper 14, and a second terminal crimper 15.

The winding of an insulated electric wire W fed to the processor 11 is first corrected and the amount of conveyance of the electric wire W (the length of the electric wire W fed) is measured in the measured length feeding section 12. Therefore, the measured length feeding section 12 includes a horizontal straightener 17 and a vertical straightener 18 for correcting the habit of winding of the electric wire W, a first feed roller 19, and a second feed roller 20 which is synchronized with the first feed roller 19. Further, an encoder (not shown) is connected to the second feed roller 20, to measure the amount of conveyance of the electric wire W.

The electric wire W fed by the measured length feeding section 12 is fed to the cutting and stripping section 13, where the electric wire W is so cut as to have a predetermined length at predetermined timing. Insulative sheaths at the leading end and the trailing end of the cut electric wire are further removed. The leading end of the electric wire from which the insulative sheath is removed (commonly called "end A") is fed by a turning arm mechanism 21 to the first terminal crimper 14, where a terminal is crimped thereon. On the other hand, the trailing end of the electric wire from which the insulative sheath is removed (commonly called "end B") is fed by an index table (not shown) to the second terminal crimper 15, where a terminal is crimped thereon.

The processor 11 further includes an electric wire pool section 23. The electric wire pool section 23 is provided in an electric wire feeding path between the measured length feeding section 12 and the cutting and stripping section 13. The electric wire W is continuously conveyed by the measured length feeding potion 12 at predetermined speed. On the other hand, cutting and stripping processing of the electric wire W in the cutting and stripping section 13 is intermittent processing performed with the electric wire W stopped once. Therefore, the electric wire pool section 23 is provided so that the feeding of the electric wire W by the measured length feeding section 12 need not be stopped even when the leading end of the electric wire W fed is stopped in the cutting and stripping section 13. The electric wire W fed by the measured length feeding section 12 hangs slack, as indicated by a broken line, in the electric wire pool section 23. Consequently, the feeding of the electric wire W by the measured length feeding section 12 need not be interrupted.

The construction of a processor 11 in an apparatus according to the present invention is not limited to the one shown in FIG. 1. For example, the processor 11 may be replaced with a processor including an intermediate portion stripping mechanism as described in Japanese Patent Laid-Open Gazette No. 250935/1993 filed as a prior application by the applicant of the present invention.

Figure 2:
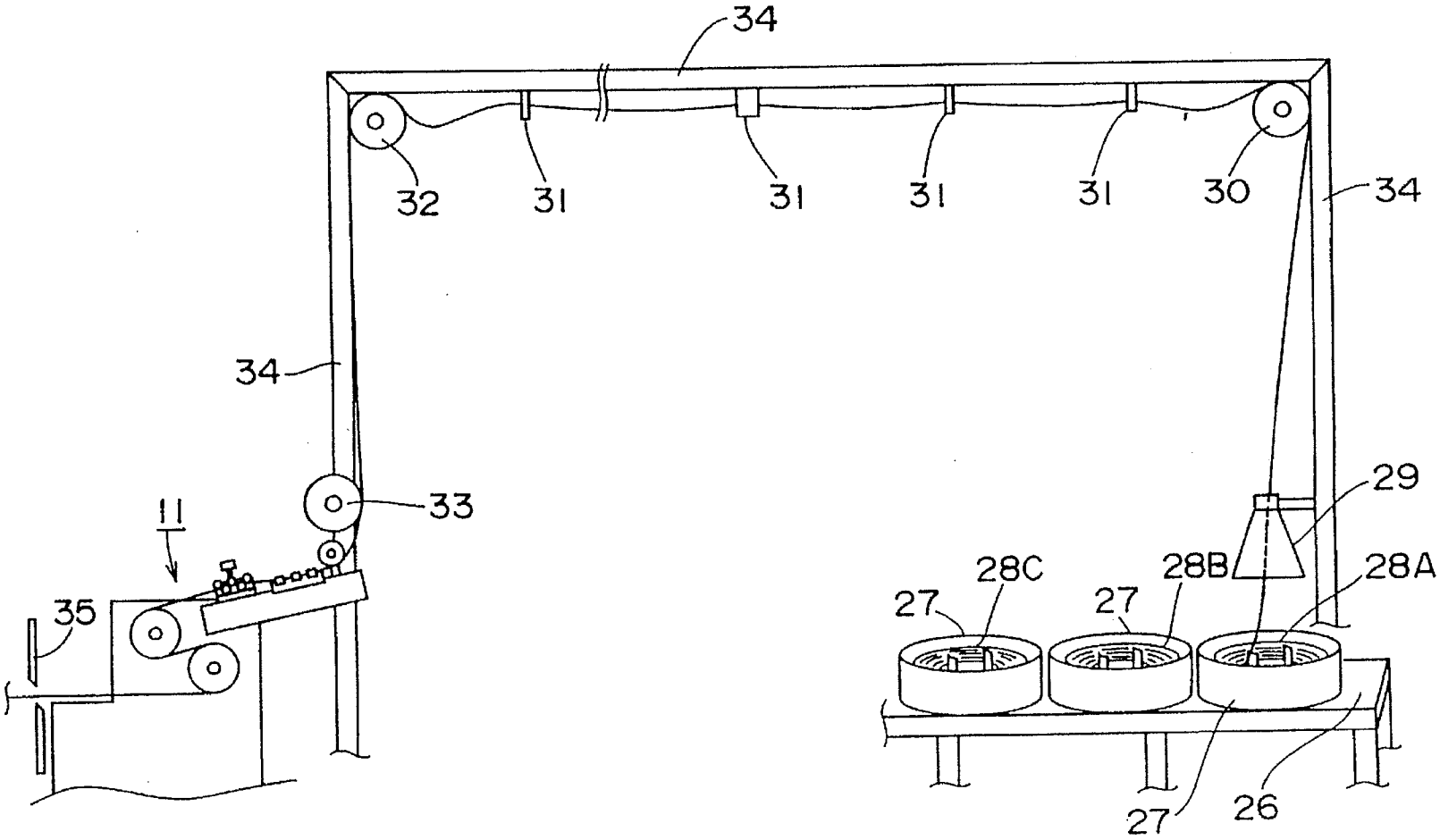
FIG. 2 is an illustration for explaining the construction of a path line.

FIG. 2 is a diagram showing the construction of a path line of the electric wire W fed to the processor 11 of the embodiment. Wound electric wires 28A, 28B, 28C, . . . which are respectively contained in containers 27 are arranged on an electric wire arrangement table 26. The wound electric wires 28A, 28B and 28C differ in type. Since the apparatus for producing electric wires with a terminal or terminals produces a lot of types of measured and processed electric wires, the wound electric wire of a desired type is selected out of the wound electric wires 28A, 28B and 28C which are arranged on the arrangement table 26.

For example, if the wound electric wire 28A is selected, the wound electric wire 28A going through a guide horn 29 is guided by a roller 30, a plurality of guides 31, and rollers 32 and 33 to the processor 11. The rollers 30, 32, 33 and the guides 31 are provided along a guide bar 34.

Figure 3:
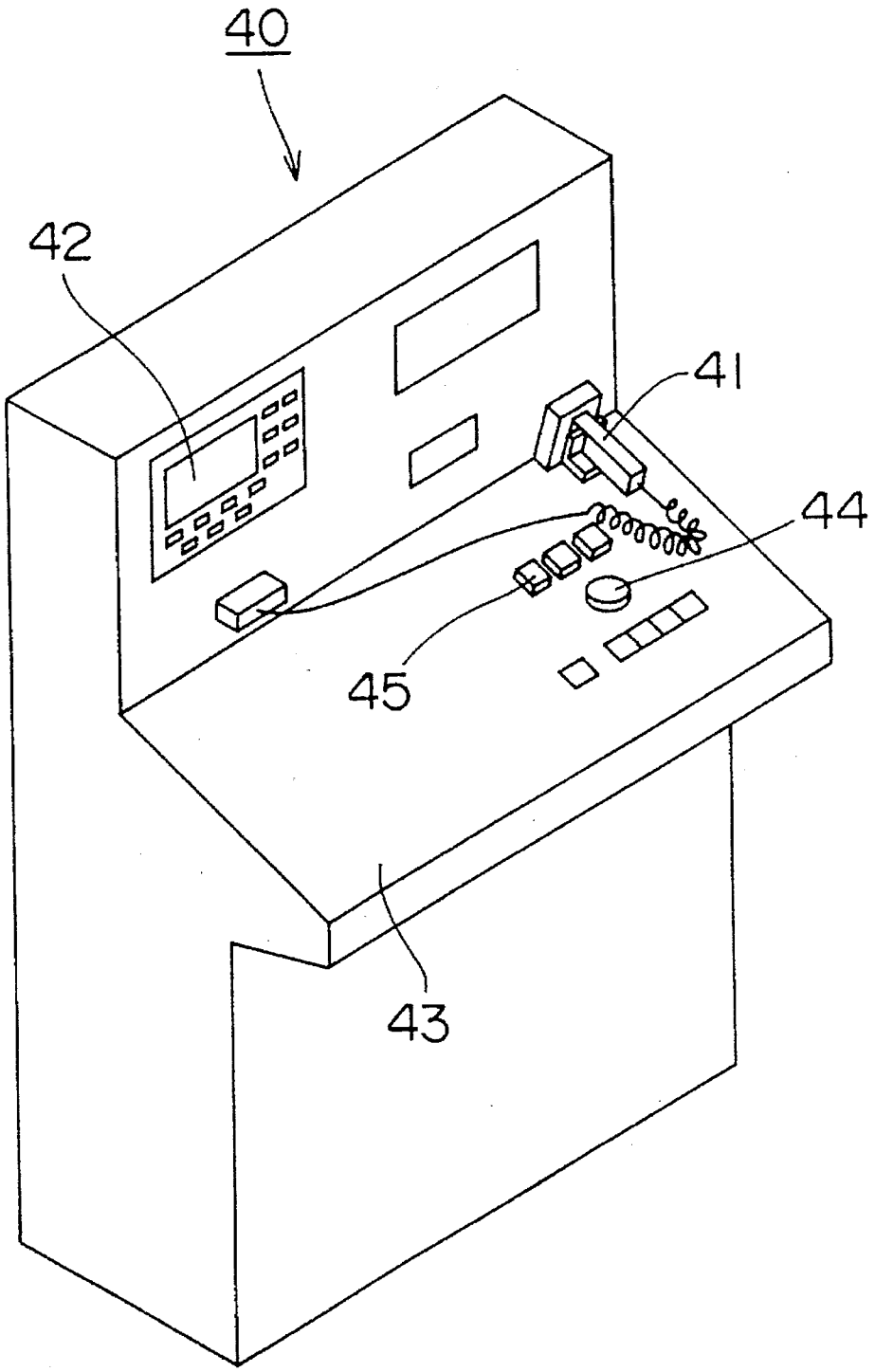
FIG. 3 is a perspective view showing the appearance of a control device 40 which is also one of the components of the apparatus according to the embodiment of the present invention.

FIG. 3 is a perspective view showing the appearance of a control device 40 which is also a component of the apparatus according to the embodiment. The control device 40 is connected to the above described processor 11 (see FIG. 1) by a cable or the like, for controlling the driving of the processor 11.

The control device 40 includes a bar code reader 41. The bar code reader 41 reads a bar code recorded on predetermined paper (commonly referred to as an "information label"). The control device 40 further includes a display 42. The display 42 is for displaying production condition data corresponding to the bar code read by the bar code reader 41 and data related to rearrangement as described later. Further, a working table 43 is formed in the control device 40 so that a worker can efficiently perform work. Various operation buttons including a start button 44 and an initial button 45 are arranged on the working table 43.

Figure 4:
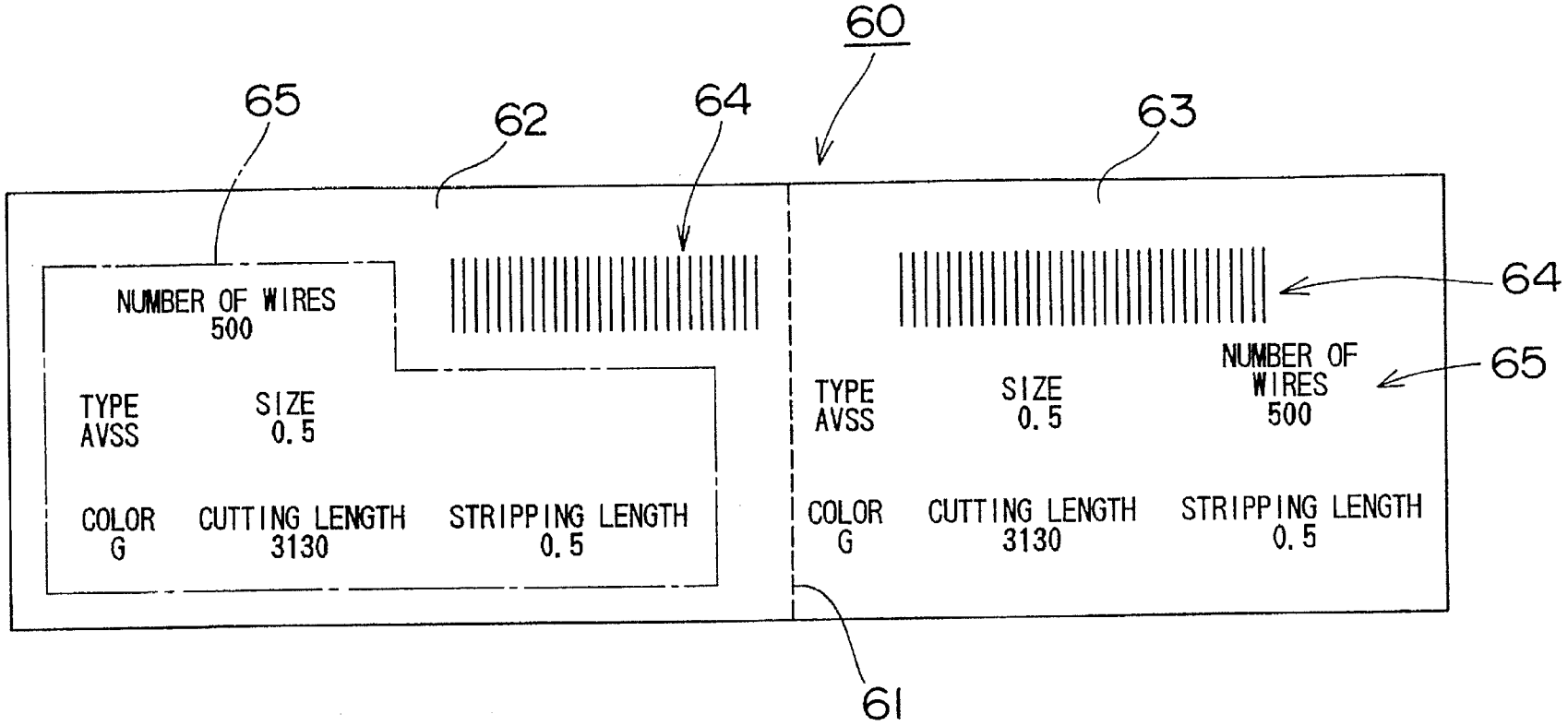
FIG. 4 is an illustration showing one example of an information label.

FIG. 4 is a diagram showing one example of predetermined paper on which the above described bar codes are recorded, that is, an information label. An information label 60 can be divided into a half stub of the label 62 and the other half stub of the label 63 by a perforation 61. Production condition data 65 are recorded on each of the half stub of the label 62 and the other half stub of the label 63. The production condition data 65 are the data required to produce electric wires with a terminal or terminals. The production condition data 65 include the data required for the processing performed by the processor 11 such as the type of electric wire, the color of the electric wire, the size of the electric wire (the cross-sectional area of the core of the electric wire), the length of cutting, the number of electric wires to be produced, the length of stripping, the type of terminal to be crimped against an end of the electric wire, the presence or absence of intermediate portion stripping, and the like. The production condition data 65 are recorded by ordinary letters, numbers, signs and the like so that they can be confirmed with the eyes of the worker. An index code attached so as to identity the production condition data 65 is recorded using a bar code 64 in relation to the production condition data 65. The index code recorded using the bar code 64 is composed of numerical values of approximately 5 to 10 figures, for example.

The bar code 64 recorded on the information label 60 is read by the bar code reader 41 shown in FIG. 3, and are inputted to the control device 40.

Thereafter, when measured and processed electric wires are produced, the other half stub of the label 63 in the information label 60 is left as a duplicate for the work in the hands of the worker, for example, and the half stub of the label 62 is attached to the measured and processed electric wires produced and can be utilized as a label of the measured and processed electric wires.

Figure 5:
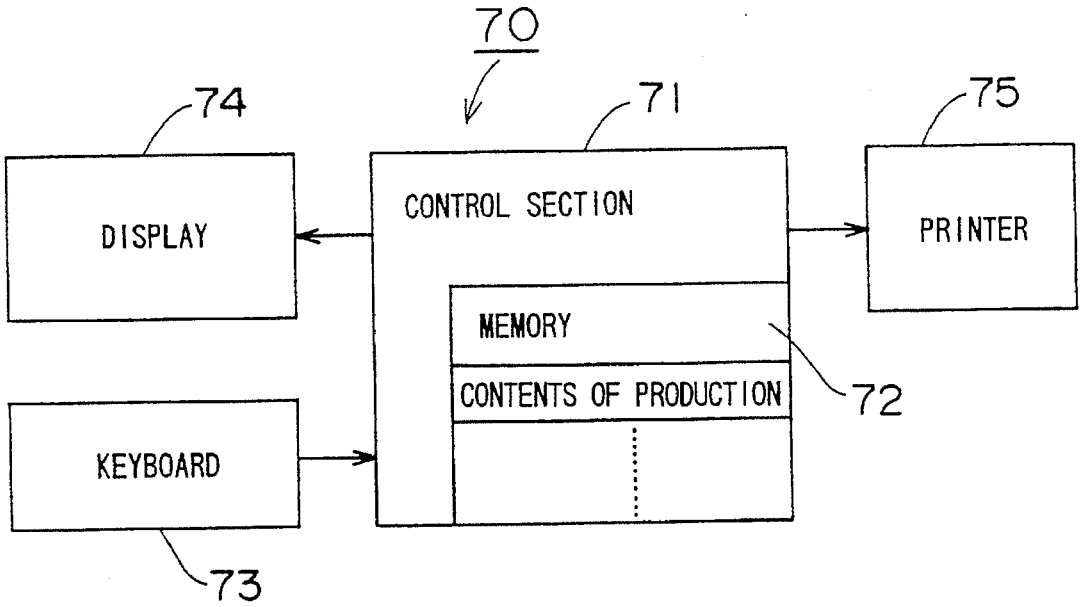
FIG. 5 is a block diagram showing an example of the construction of a central managing apparatus having a function for issuing an information label.

FIG. 5 is a block diagram showing the schematic construction of a central managing apparatus 70 having a function of issuing the above described information label 60 on which production condition data are recorded. The central managing apparatus 70 can be constructed using an office computer, for example. The central managing apparatus 70 includes a control section 71. A program for issuing an information label is stored in the control section 71. The control section 71 further includes a memory 72 in which the production condition data registered and an index code attached to the production condition data are stored.

The central managing apparatus 70 includes a keyboard 73, a display 74, and a bar code printer 75.

Figure 6:
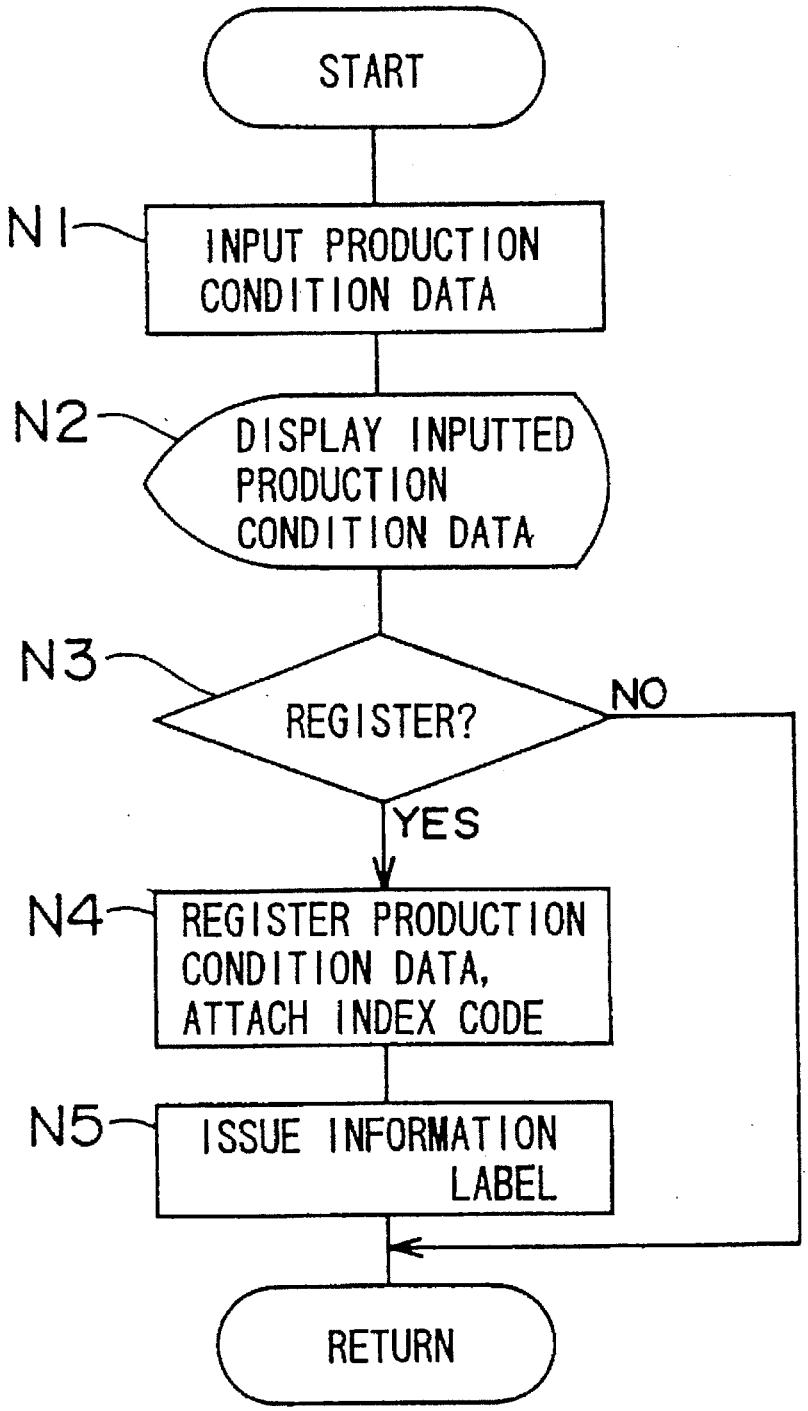
FIG. 6 is a flow chart showing operations performed by the central managing apparatus shown in FIG. 5.

FIG. 6 is a flow chart showing operations for registering production condition data and issuing an information label in the central managing apparatus 70 shown in FIG. 5. Production condition data are first inputted from the keyboard 73 (step N1). The production condition data include the type of electric wire to be processed, the color of the electric wire, the size of the electric wire (the cross-sectional area of the core of the electric wire), the length of cutting of the electric wire (the number of electric wires to be produced), the length of stripping at both ends of the electric wire, the type of terminal to be crimped against each end of the electric wire, the type of applicator used, the presence or absence of intermediate portion stripping, and the like, as described above. The order in which the production condition data are inputted is displayed on the display 74, for example. Accordingly, an operator inputs the production condition data from the keyboard 73 while watching the display on the display 74.

The inputted production condition data are displayed on the display 74 (step N2). The operator confirms the production condition data displayed on the display 74, and presses a register key (not shown) of the keyboard 73 so as to register, if there is no error in the production condition data, the contents of the production condition data. On the other hand, if there is an error in the displayed production condition data, the operator corrects the production condition data and then, presses the register key.

In the control section 71, upon input from the register key (step N3), an index code is attached to the inputted production condition data (step N4). The production condition data and the index code are registered in the memory 72 with establishing a correspondence therebetween.

The production condition data can be entered in the central managing apparatus 70 by reading a plurality of production condition data which are previously stored in a storage device such as a disk, or directly transmitting production condition data previously stored in different computers to the central managing apparatus 70 by transmission between the computers.

After the production condition data and the index code are registered in the memory 72, the printer 75 is driven so that the production condition data are printed on paper and the index code attached thereto is printed using a bar code on the paper, thereby to issue an information label (step N5).

Only one central managing apparatus 70 may be provided in one office or factory, for example. Information labels given to respective control devices 40 (see FIG. 3) included in a plurality of apparatuses for producing electric wires with a terminal or terminals can be also collectively issued from and managed by the one central managing apparatus 70. Consequently, it is possible to grasp the conditions of production of the plurality of apparatuses for producing electric wires with a terminal or terminals under the management of the central managing apparatus 70 correctly and synthetically.

Figure 7:
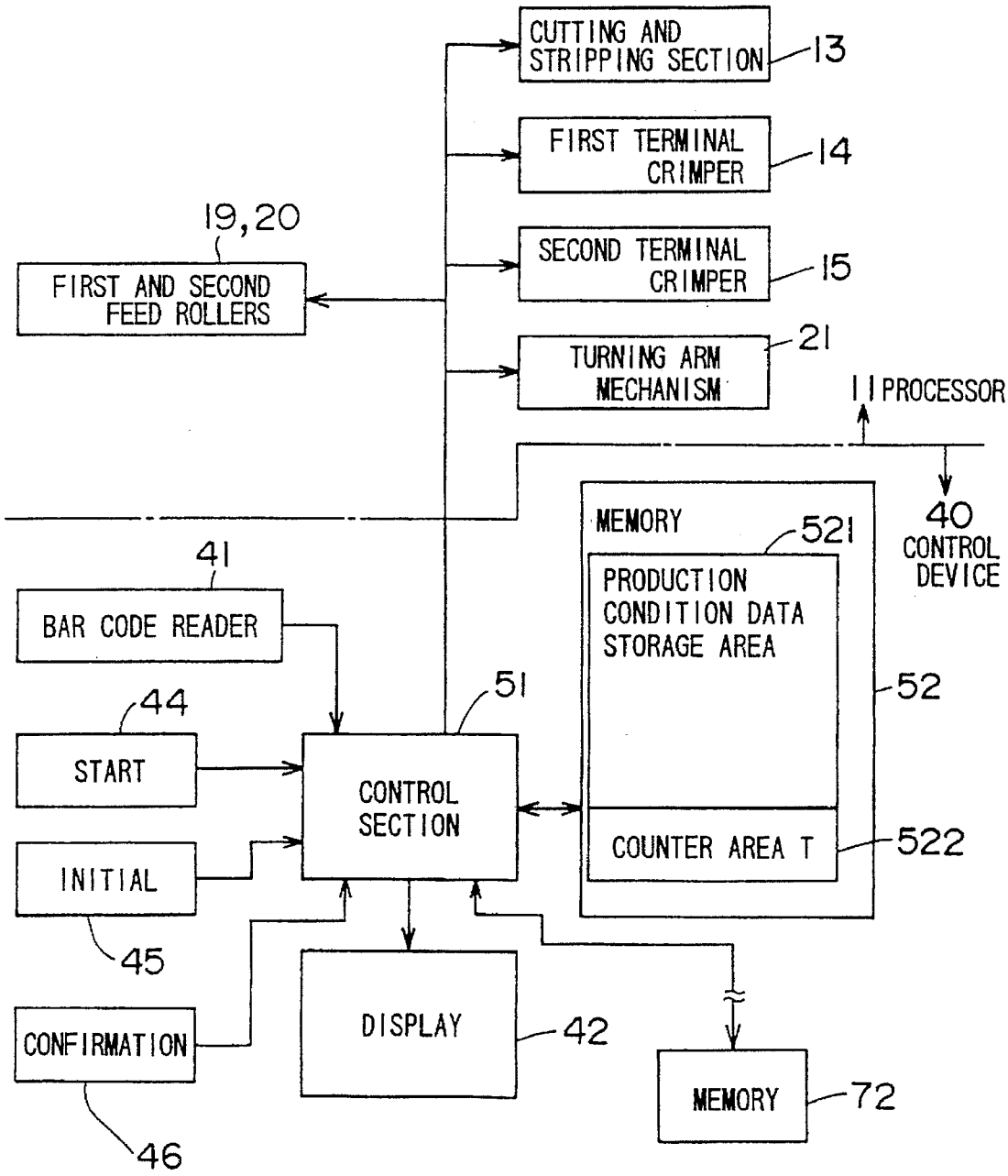
FIG. 7 is a block diagram showing the construction of the apparatus according to the embodiment of the present invention.

FIG. 7 is a block diagram showing the construction of the apparatus for producing electric wires with a terminal or terminals according to the embodiment of the present invention. The apparatus includes a processor 11 and a control device 40, as described above. The control device 40 includes a control section 51 for carrying out control over the entire part of the apparatus. The control section 51 is constituted by a CPU (Central Processing Unit) and the like. An index code read by the above described bar code reader 41 and signals from the start button 44, the initial button 45 and a confirmation button 46 are fed to the control section 51. The meanings of the signals from the buttons, for example, will be described later. Signals from other operation buttons may also be applied, which are not illustrated in FIG. 7.

A memory 52 is connected to the control section 51. The control section 51 is further connected to a memory 72 through the control section 71 in the above described central managing apparatus 70 shown in FIG. 5. When a bar code on an information label is read by the bar code reader 41 and an index code represented by the read bar code is inputted, the control section 51 accesses the memory 72 (see FIG. 5) to read out production condition data corresponding to the index code. The production condition data include the length L of an electric wire to be produced, the number Q of measured and processed electric wires to be produced, the type of electric wire, and the like, as described above. The production condition data read out from the memory 72 (see FIG. 5) are stored in a production condition data storage area 521 in the memory 52.

The production condition data storage area 521 is constituted by an FIFO (First In First Out) table in the present embodiment. FIG. 8 is an illustration of the FIFO table 521. Referring to FIG. 8, the FIFO table 521 has a capacity for storing a plurality of production condition data. The memory 72 (see FIG. 5) in the central managing apparatus 70 is accessed every time bar codes on a plurality of information labels are successively read by the bar code reader 41, and production condition data corresponding to index codes represented by the read bar codes are read out. The production condition data read out are successively stored in the FIFO table 521.

In the FIFO table 521, the production condition data are stored in areas 1, 2, 3, 4, . . . in the order inputted. At the time of reading out, the production condition data stored in the area 1 are read out. When the production condition data stored in the area 1 are read out, the production condition data stored in the area 1 are erased or are moved into a processed area in the memory 72 in the central managing apparatus 70. The production condition data stored in the respective areas are shifted one by one. For example, the production condition data stored in the area 2 are shifted to the area 1, the production condition data stored in the area 3 are shifted to the area 2, and the production condition data stored in the area 4 are shifted to the area 3. As a result, the data stored in the FIFO table 521 are successively read out in the order stored.

The FIFO table may be replaced with an ordinary memory table as the production condition data storage area 521 so that production condition data stored are assigned priorities for reading.

As another construction, the control section 51 may be provided with an external storage medium reading device (for example, a flexible disk reader), for example, without connecting the control section 51 and the memory 72 in the central managing apparatus 70 to each other as described above. In this case, it is only necessary to down load in a flexible disk, for example, a plurality of production condition data and index codes which are registered in the memory 72, and set the flexible disk in the flexible disk reader controlled by the control section 51.

Referring to FIG. 7 again, the memory 52 further includes a counter area 522 for counting the number of measured and processed electric wires produced.

The control section 51 further outputs control signals to the first and second feed rollers 19 and 20, the cutting and stripping section 13, the first terminal crimper 14, the second terminal crimper 15, the turning arm mechanism 21, and the like included in the processor 11. The display 42 is further connected to the control section 51. Information required for rearrangement is displayed on the display 42 for each rearrangement, as described later.

Figure 9:
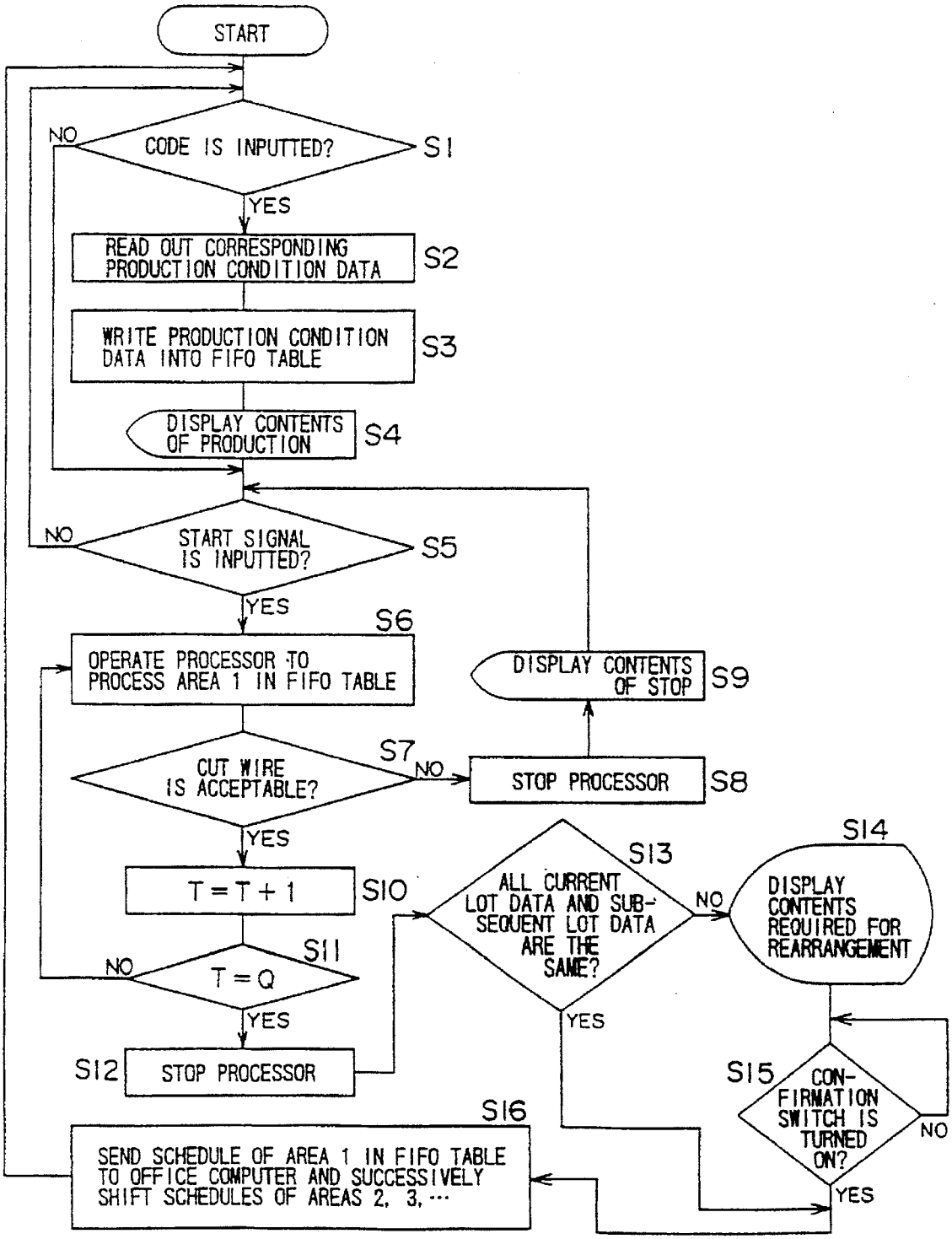
FIG. 9 is a flow chart for explaining operations performed by the apparatus according to the embodiment of the present invention.

FIG. 9 is a flow chart showing operations performed by the apparatus for producing electric wires with a terminal or terminals according to the present embodiment, centered around a control operation of the above described control section 51. The bar code 64 on the information label 60 (see FIG. 4) is first read by the bar code reader 41, and the index code represented by the bar code 64 is inputted to the control section 51. The control section 51 accesses, when the index code is given thereto (step S1), the memory 72 through the control section 71 in the central managing apparatus 70 (see (FIG. 5), and reads out from the memory 72 the production condition data corresponding to the index code (step S2). The production condition data read out are stored in the FIFO table 521 in the memory 52 (step S3). The production condition data read out from the memory 72 are displayed on the display 42 (step S4).

The control section 51 judges whether or not a start 5 signal is fed with the push of the start button 44 (step S5). If the start signal is not fed and the index code read by the bar code reader 41 is further given (step S1), the above described processing in the steps S2, S3 and S4 is performed.

In this case, the production condition data stored in the FIFO table 521 in the memory 52 are stored in the areas 1, 2, 3, . . . in the order stored. Consequently, the production condition data read out from the FIFO table 521 are read out in the order stored.

In the procedure for reading bar codes on information labels by the above described bar code reader 41, it is preferable that a worker arranges the information labels in the order in which work efficiency rises and causes the bar code reader 41 to read the bar codes on the information labels in the order. Some rearrangement works may be easy and others may be difficult for each worker to perform depending on the degree of skill, the liking and the like of the worker. For example, each worker has strong points and weak points. Some workers may be good at replacing not applicators but electric wires. Another worker may be good at replacing not electric wires but terminals and the like. If the worker arranges the order of the information labels to perform the work more efficiently, and if the bar codes on the information labels are read in order, then the apparatus is controlled to perform rearrangement works in the order.

On the other hand, when the FIFO table is replaced with an ordinary memory area as the production condition data storage area 521, arbitrary priorities for reading may be assignable to the production condition data stored. In this case, the worker can also cause the bar code reader 41 to read the bar codes on the plurality of information labels to store the production condition data in the production condition data storage area 521 and then, assign the production condition data priorities for reading out in an order different from the order stored. If such construction is adopted, the construction is useful for a case, for example, where it is desired to cause the bar code reader 41 to read the bar codes on the information labels to store the production condition data and then, control the production of electric wires in an order different from the order stored. It is considered that the construction is useful for cases such as a case where a worker has to take over the work after an other worker finishes reading the bar codes on the information labels using the bar code reader.

The above described processing in the step S2 may be the processing for reading out production condition data corresponding to an index code from a flexible disk or another memory. Specifically, the flexible disk reader, for example, may be connected to the control section 51, as described above. Where a flexible disk in which an index code and production condition data corresponding thereto are stored is loaded on the flexible disk reader, the production condition data may be read out from the flexible disk. Alternatively, where another memory (for example, a CD-ROM) is provided in the control section 51, and an index code and production condition data corresponding thereto are previously stored in the memory, it is possible to read out the production condition data from the memory.

When the start button 44 is then pushed by the worker, the control section 51 judges whether or not a start signal is inputted (step S5). In order to read out the production condition data A in the area 1 in the FIFO table 521 and produce a measured and processed electric wire corresponding to the production condition data A, the processor 11 is operated (step S6).

When the processing is started, the control section 51 judges, every time an electric wire is cut by the cutting and stripping section 13 in the processor 11, whether or not the cut electric wire is an acceptable product (step S7). The judgment can be made on the basis of image data from a checker camera provided in the cutting and stripping section 13, for example. If the cut electric wire is not an acceptable product as a result of the judgment in the step S7, the processor 11 is stopped (step S8), and the cause of the stop of the processor 11 is displayed on the display 42 (step S9). The worker watches the display on the display 42 to know that the cut electric wire is not an acceptable product, and removes the electric wire which is not an acceptable product. In addition, the worker removes the cause of the defective electric wire if necessary. Then, the worker sets the processor 11 again to an operable state, and pushes the start button 44. As a result, the processing is resumed.

If it is judged in the step S7 that the cut electric wire is an acceptable product, a count value T in the counter area 522 in the memory 52 is incremented by one (step S10). The processing in the step S6 and the subsequent steps is repeated until the count value T in the counter area 522 reaches a predetermined number of electric wires to be produced Q.

If it is judged in the step S11 that the count value T in the counter area 522 is Q, the program proceeds to the step S12 and the processor 11 is stopped. At this time point, the processing of the production condition data A which have been stored in the area 1 in the FIFO table 521 is terminated, to complete the production of Q measured and processed electric wires.

In the control section 51, it is then judged whether or not all the production condition data A corresponding to the measured and processed electric wires produced in the steps S6 to S11, that is, current lot data and subsequent lot data (production condition data for the subsequent lot) are the same (step S13). This judgment is made by comparing the production condition data A stored in the area 1 in the FIFO table 521 in the memory 52 and production condition data B in the subsequent area 2 with each other.

As a result of the comparison, if all the current lot data and the subsequent lot data are not the same, the contents required for rearrangement are displayed on the display 42 based on the result of the comparison (step S14). A concrete example of the display at this time is illustrated in FIG. 10. In this concrete example, the following are displayed:

(1) A terminal for No. 1 (at the end A) and a terminal for No. 2 (at the end B) must be replaced with "MT090FL" and "HSG250F".

(2) An applicator for No. 1 (at the end A) and an applicator for No. 2 (at the end B) must be respectively "No. 45" and "No. 32" applicators.

(3) The length of stripping at the end A (No. 1) of the electric wire and the length of stripping at the end B (No. 2) of the electric wire must be changed.

(4) The length of stripping at the end A and the length of stripping at the end B must be adjusted to "5.6 mm" and "4.3 mm".

(5) The type and size of the electric wire must be changed.

(6) The type and size of the electric wire used after the change must be "○○XX○○".

(7) A vinyl height (V/H) in the first terminal crimper (see FIG. 1) for crimping a terminal against the end A of the electric wire must be changed, and a crimp height (C/H) and a vinyl height (V/H) in the second terminal crimper 5 (see FIG. 1) for crimping a terminal against the end B of the electric wire must be changed.

When a terminal fitting is crimped against an electric wire, a part of the terminal fitting is caulked on the core of the electric wire stripped, and another part thereof is caulked on an insulated portion of the electric wire. The above described crimp height (C/H) is the height of the part caulked on the core, and the vinyl height (V/H) is the height of the part caulked on the insulated portion.

The worker performs rearrangement work in accordance with the contents of the display on the display 42. In the concrete example of FIG. 10, the terminals for No. 1 and No. 2 are replaced with terminals displayed, and the applicators are also replaced. In addition, the lengths of stripping at the ends A and B are adjusted to the sizes displayed. Further, the electric wire is replaced with one of the type and the size displayed. At the time of the replacement, the end of the previous electric wire is cut, and a new electric wire is connected to the end. Furthermore, the vinyl height in the first terminal crimper 14 is changed, and the crimp height and the vinyl height in the second terminal crimper 15 are changed.

In the present embodiment, a so-called touch panel composed of a pair of transparent electrode sheets is provided on a display screen of the display 42. In the present embodiment, after replacing the terminals and the applicators with new terminals and new applicators, the worker touches and lightly depresses a display section on which the names of the new terminals and the new applicators are displayed so that the display disappears. Instead of causing the display to disappear, the display density or the display color may be changed.

After the replacement, the adjustment and the like are terminated, the worker lightly depresses display of "confirmation" 46 displayed on the display 42. Consequently, a confirmation signal is fed to the control section 51.

Since the contents of the work required for the rearrangement are displayed on the display 42, if the execution of the work is inputted with the touch panel every time each of the contents has been exerted, it is possible to reliably perform the rearrangement work without omission.

Since only the contents of the work required for the rearrangement are displayed on the display 42, even an unskilled worker can reliably perform the rearrangement work in a short time by quickly performing only the work displayed.

Consequently, an unskilled worker becomes accustomed to the work through short work. In addition, it is possible to reduce the difference in work time between an unskilled worker and a skilled worker. This means that the production can be standardized all the more as viewed from the entire factory.

Figure 11:
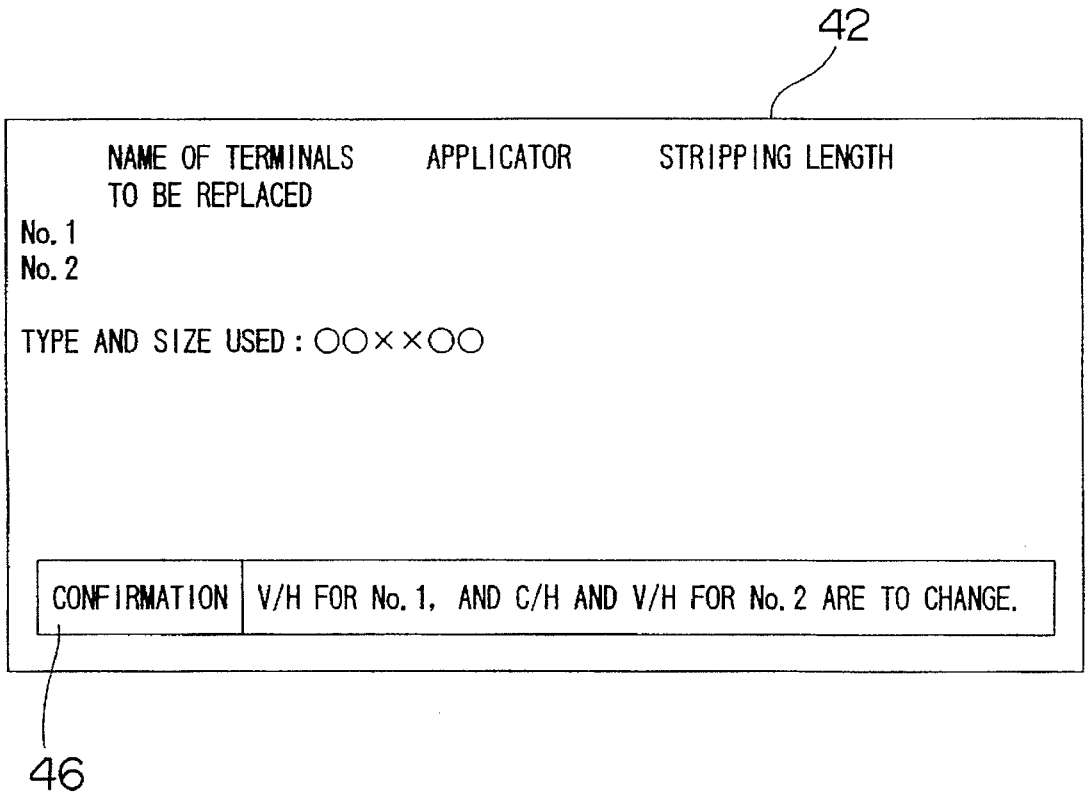
FIG. 11 is a diagram showing another example of display on the display 42 at the time of rearrangement.

Another concrete example of display on the display 42 based on the processing in the step S14 shown in FIG. 9 is illustrated in FIG. 11.

In the example of the display shown in FIG. 11, the following are displayed:

(1) The type and the size of an electric wire must be changed into "○○XX○○", and (2) A crimp height and a vinyl height in each of the first terminal crimper and the second terminal crimper must be changed with the change (1) in the rearrangement. In this case, only the contents of the display shown in FIG. 11 are enough for the rearrangement work.

The display on the display 42 in the step S14 is not limited to the above described concrete examples. For example, the display on the display 42 may be the one shown in FIG. 12.

As shown in FIG. 12, it is indicated that eleven more measured and processed electric wires are to be produced, and electric wires must be replaced at the present time point. Further, it is indicated that the length of an electric wire to be added in replacing electric wires is 429 mm, the type of electric wire to be connected subsequently to the electric wire to be added is AVSS, the size thereof is 0.5, and the color thereof is B (B means "black"). Also in the case of the display shown in FIG. 12, it is preferable that a switch for confirming the completion of rearrangement work, for example, is displayed. "The length of an electric wire to be added in replacing electric wires" corresponds to the length from the lower end of the guide horn 29 to the position where the current electric wire is supposed to be cut. The length $\alpha$ of the electric wire to be added is given by the following equation using the length, L, of a path of the electric wire from the guide horn 29 to the processor 11, the length, 1, of the measured electric wire currently being produced, and the number, m, of an electric wire or electric wires of the current type to be produced subsequently to the replacement of electric wires:

$$\alpha = l \cdot m - L$$

If the electric wire being currently used is cut in the position of the length $\alpha$ from the lower end of the guide horn 23 and the subsequent electric wire is coupled thereto, the type of electric wire to be produced can be changed without wasting the electric wire.

The foregoing concrete example of the display on the display 42 is one example. The display on the display 42 may be other ones than the above described display. It is important that only the work required for rearrangement is displayed on the display 42 so that the worker can quickly perform replacement work in accordance with the display.

The FIG. 9 description is continued.

When the rearrangement work is performed in accordance with the display on the display 42 in the step S14, and the confirmation switch 46 is turned on in the step S15, then the program proceeds to the step S16. In the step S16, the production condition data stored in the area 1 in the FIFO table 521 are transferred to the production completion area in the memory 72 in the central managing apparatus 70, and the production condition data in the respective areas 2, 3, 4, . . . are successively shifted. For example, the production condition data stored in the area 2 are shifted to the area 1, the production condition data stored in the area 3 are shifted to the area 2, and the production condition data stored in the area 4 are shifted to the area 3. As a result, when the shifting is terminated, the production condition data stored in the area 1 in the FIFO table 521 are replaced with the production condition data so far stored in the area 2. The program is then returned to the first processing. If it is judged in the step S5 that the start signal is inputted, the production of measured and processed electric wires for the subsequent lot based on the subsequent production condition data is started.

In the above described embodiment, such control is carried out that, every time an index code is inputted in the step S1, production condition data to which the index code is attached are read out from the memory 72 (step S2), and the production condition data read out are stored in the FIFO table 521 (step S3).

In place of such control, the following construction may be adopted. Specifically, the control may be replaced with such control that when an index code is inputted, the index code is directly stored in the FIFO table 521. An index code in the area 1 in the FIFO table 521 is read out, and then, production condition data corresponding to the index code read out are read out from the memory 72 in the step S6.

In the above described embodiment, description was made of a case where a bar code represents not production condition data themselves but an index code corresponding to the production condition data. Accordingly, the production condition data corresponding to the index code are read out from the memory 72 or the like, and the production condition data read out are stored in the FIFO table 521.

In place of such construction, a bar code may represent production condition data themselves. In this case, the bar code may be slightly long. However, the production condition data can be directly stored in the FIFO table 521 since data read by the bar code reader 41 are production condition data themselves.

Furthermore, construction intermediate between the construction described in the present embodiment and such construction that a bar code represents production condition data themselves can be also adopted. Specifically, parts of the production condition data are represented by a bar code, and the remaining production condition data are stored with an index code attached thereto in the central managing apparatus 70. In this case, data from the bar code reader 41 include the index code and the parts of the production condition data, and the remaining production condition data are read out from the memory 72 in the central managing apparatus 70.

It is possible to suitably choose which of the above described data are represented by a bar code recorded on an information label in consideration of the capacity of data, the convenience for use, and the like.

Furthermore, data on an information label may be represented using not a bar code but notations which can be read by an OCR (Optical Character Reader). Alternatively, the data may be represented by a combination of punch holes.

Additionally, the following construction may be adopted when the worker performs the rearrangement work on the basis of the contents of the rearrangement displayed on the display 42 in the step 14.

Specifically, bar codes arranged for each of components to be rearranged, that is for a terminal, an electric wire, an applicator and the like may be attached to each of the components. With respect to a component to which a bar code cannot be easily attached, for example, an electric wire or a terminal, the bar code may be attached to a reel of the electric wire or a reel of the terminals. In the case of the rearrangement, the bar code attached to each of the components to be rearranged is read. The information representative of the read bar code is given to the control section 51. In the control section 51, the subsequent lot data stored in the FIFO table 521 are read out, and the given information representative of the bar code attached to the component to be rearranged is compared with the subsequent lot data. If the bar code attached to the component to be rearranged is adapted to the subsequent lot data, the adaptation may be outputted. On the other hand, if the bar code attached to the component to be rearranged is not adapted to the subsequent lot data, it is reported that the rearrangement work is incompletely performed. Consequently, it is possible to judge errors in change and errors in setting of the components and the like at the time of the rearrangement, thereby making it possible to prevent incomplete setting at the time of the rearrangement.

Although the present invention has been described and illustrated in detail, it is clearly understood that the description is by way of illustration and example only and is not to be taken by way of limitation, the spirit and scope of the present invention being limited only by the terms of the appended claims.

What is claimed is:

1. An apparatus for producing electric wires with a terminal, comprising:

storing means for storing a plurality of pieces of data required to produce a plurality of types of electric wires with a terminal;

reading out means for reading out from the storing means, in response to that a certain type of electric wire with a terminal has been produced on the basis of one of the plurality of pieces of data stored in the storing means, data corresponding to a type of electric wire with a terminal to be subsequently produced;

extracting means for comparing data read out by the reading out means with data corresponding to the electric wire with a terminal which has been produced and for extracting a portion which differs in contents of the data; and displaying means for displaying the portion of data extracted by the extracting means.

2. An apparatus according to claim 1, further comprising:

reading means for reading information carried on an information sheet, and writing means for writing data required to produce the electric wire with a terminal into the storing means on the basis of the information read by said reading means.

3. An apparatus according to claim 2, wherein the storing means has a FIFO table from which data are outputted in an order inputted, and the writing means writes the data into the FIFO table.

4. An apparatus according to claim 2, wherein the information recorded on the information sheet is identification information for identifying data, and the writing means includes means for reading out the data corresponding to the information read by the reading means from a predetermined storage medium and means for writing the data read out into the storing means.

5. An apparatus according to claim 4, wherein the storage medium is a memory provided for a central managing apparatus capable of sending and receiving information to and from the apparatus.

6. An apparatus according to claim 4, wherein the storage medium is a portable disk member.

7. An apparatus according to claim 2, wherein the information sheet carries a bar code representative of information.

8. An apparatus according to claim 1, wherein the displaying means includes means for displaying contents of work corresponding to the different portion of the data extracted by the extracting means, said apparatus further comprising confirmation inputting means to be operated after the contents of work have been achieved, and means for changing a manner of display of the contents of work in response to input from the confirmation inputting means.

9. An apparatus according to claim 1, wherein the data include a type of electric wire, and a type of terminal to be crimped against an end of the electric wire.

10. An apparatus according to claim 1, wherein the data include a type of an applicator for crimping a terminal.

11. An apparatus according to claim 1, further comprising:

measuring and cutting means for measuring and cutting an electric wire, terminal crimping means for crimping a terminal on an end of the cut electric wire, and controlling means for controlling the measuring and cutting means and the terminal crimping means on the basis of the data read out from the storing means by the reading out means.

12. A system for producing electric wires with a terminal, comprising:

at least one apparatus for producing electric wires with a terminal; and a central managing apparatus for sending and receiving information to and from the apparatus for producing electric wires with a terminal, the central managing apparatus managing the production of an electric wire by the apparatus for producing electric wires with a terminal;

the central managing apparatus including:

inputting means for inputting data required to produce an electric wire with a terminal, first storing means for storing the data inputted from the inputting means, the first storing means being capable of storing a plurality of pieces of data required to produce a plurality of types of electric wires with a terminal, and means for issuing an information sheet carrying thereon identification information for identifying the data inputted from the inputting means, the apparatus for producing electric wires with a terminal including:

reading means for reading the identification information carried on the information sheet issued by the information sheet issuing means, second storing means for storing a plurality of pieces of data required to produce a plurality of types of electric wires with a terminal, writing means for reading out the data corresponding to the identification information read by the reading means from the first storing means and writing the data into the second storing means, reading out means for reading out from the second storing means, in response to that a certain type of electric wire with a terminal has been produced on the basis of one of the plurality of pieces of data stored in the second storing means, data corresponding to a type of electric wire with a terminal to be subsequently produced, extracting means for comparing the data read out by the reading means with the data corresponding to the electric wire with a terminal which has been produced and extracting a portion of data which differs in contents, and displaying means for displaying the portions of data extracted by the extracting means.

13. A system according to claim 12, wherein the second storing means has a FIFO table from which data are outputted in an order inputted, and the writing means writes the data into the FIFO table.

14. A system according to claim 12, wherein the central managing apparatus further includes means for providing the identification information to the data inputted from the inputting means, and means for writing the data inputted from the inputting means into the first storing means while establishing a correspondence with the identification information.

15. A system according to claim 12, wherein the information sheet carries a bar code representative of identification information.

16. A system according to claim 12, wherein the displaying means includes means for displaying contents of work corresponding to the different portions of the data extracted by the extracting means, the apparatus for producing electric wires with a terminal further including:

confirmation inputting means to be operated after the contents of work have been achieved, and means for changing a manner of display of the contents of work in response to input from the confirmation inputting means.

17. A system according to claim 12, wherein the data include a type of electric wire and a type of a terminal to be crimped on an end of the electric wire.

18. A system according to claim 12, wherein the data include a type of an applicator for crimping a terminal.

19. A system according to claim 12, wherein the apparatus for producing electric wires with a terminal further includes:

measuring and cutting means for measuring and cutting a electric wire, terminal crimping means for crimping a terminal against an end of the cut electric wire, and controlling means for controlling the measuring and cutting means and the terminal crimping means on the basis of the data read out from the second storing means by the reading out means.

* * * * *